US007699676B2

(12) United States Patent
Nicholson

(10) Patent No.: US 7,699,676 B2
(45) Date of Patent: Apr. 20, 2010

(54) BUOY SYSTEM

(75) Inventor: Michael Nicholson, 7411 Rogers Ave., Upper Darby, PA (US) 19803

(73) Assignee: Michael Nicholson, Upper Darby, PA (US)

( * ) Notice: Subject to any disclaimer, the term of this patent is extended or adjusted under 35 U.S.C. 154(b) by 17 days.

(21) Appl. No.: 11/818,514

(22) Filed: Jun. 14, 2007

(65) Prior Publication Data

US 2008/0085643 A1 Apr. 10, 2008

Related U.S. Application Data

(60) Provisional application No. 60/907,528, filed on Apr. 6, 2007, provisional application No. 60/817,580, filed on Jun. 29, 2006, provisional application No. 60/814,297, filed on Jun. 15, 2006.

(51) Int. Cl.
*B63B 22/16* (2006.01)

(52) U.S. Cl. ..... 441/6; 441/28

(58) Field of Classification Search ..... 441/1, 441/6, 11, 13, 16–18, 21–29
See application file for complete search history.

(56) References Cited

U.S. PATENT DOCUMENTS

| | | | | |
|---|---|---|---|---|
| 2,367,818 | A * | 1/1945 | Diehl | 441/16 |
| 3,089,156 | A | 5/1963 | Hamm | |
| 3,121,889 | A | 2/1964 | Gentile | |
| 3,441,962 | A * | 5/1969 | Williams | 441/6 |
| 4,098,214 | A * | 7/1978 | Ogura | 114/267 |
| 4,405,303 | A | 9/1983 | Smith | |
| 4,501,563 | A | 2/1985 | Johnson | |
| 4,781,636 | A | 11/1988 | Schurr | |
| 5,087,216 | A | 2/1992 | Noggle | |
| 5,273,468 | A * | 12/1993 | Nichols | 441/6 |
| 5,360,359 | A | 11/1994 | Reynolds | |
| 6,086,439 | A | 7/2000 | Vasile | |
| 6,273,773 | B1 * | 8/2001 | Bourke | 441/6 |

* cited by examiner

*Primary Examiner*—Stephen Avila
(74) *Attorney, Agent, or Firm*—Law Offices of John A. Parrish

(57) ABSTRACT

A buoy system having a buoyant flotation reel 10 for retaining a length of anchor line 95 and for supporting a display pole is disclosed. The anchor line 95 includes an anchor weight 98 thereon and a reel insert 15 for placement within the interior of the buoyant flotation reel 10. The display pole 5 includes a pivot ball 20 thereon for mounting within a socket component 27 mounted on the reel insert 15 to enable the display pole 5 to move within the socket component 27 relative to the reel insert 15. A kit for the buoy system also is disclosed.

27 Claims, 19 Drawing Sheets

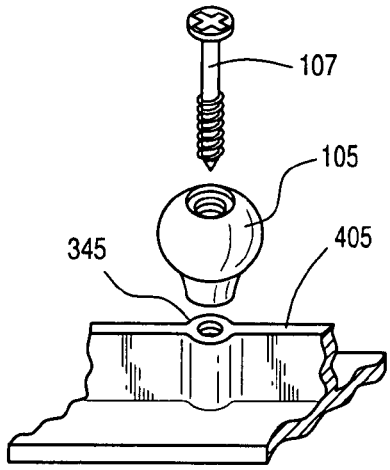
FIG. 3D
FIG. 3C
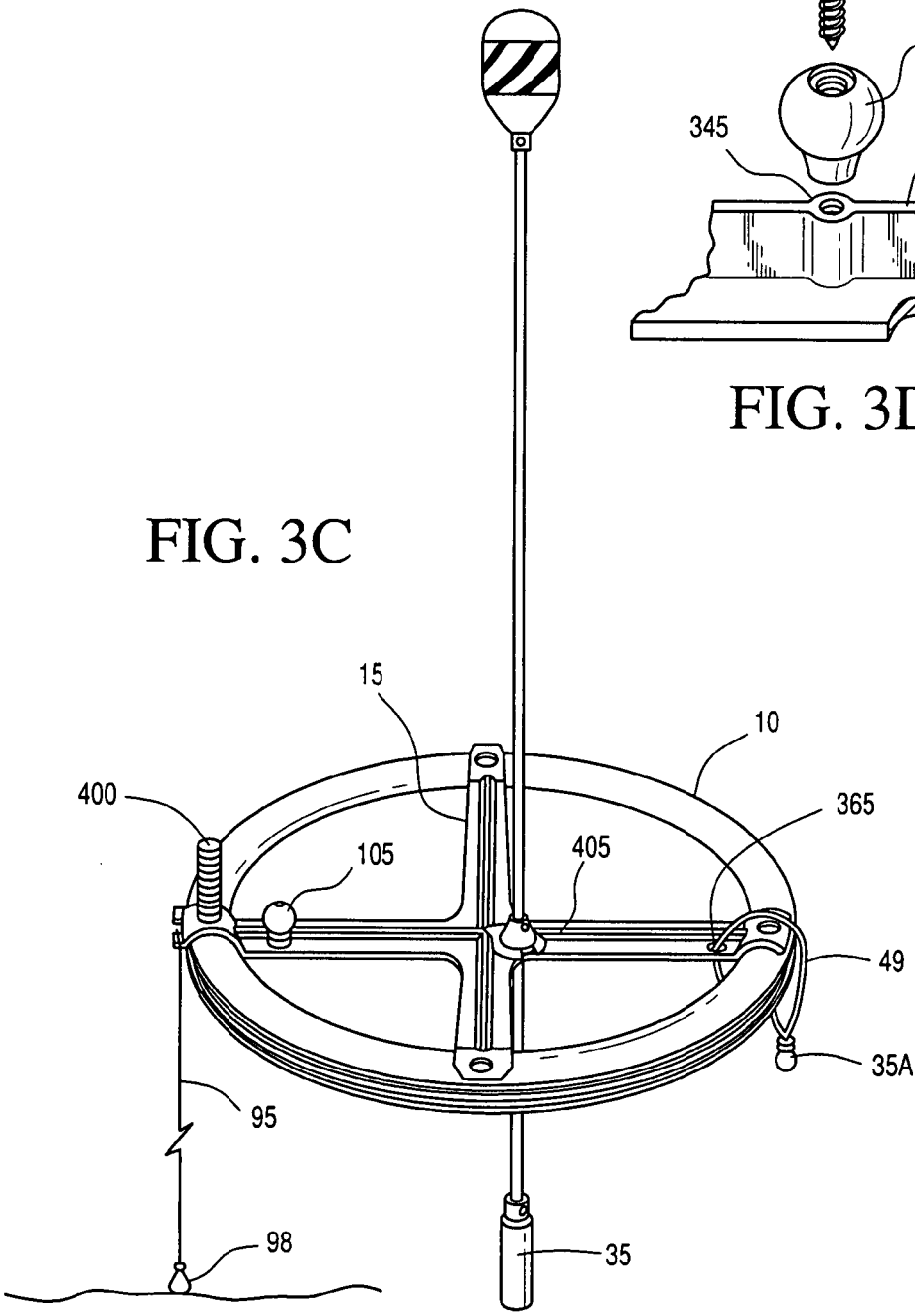

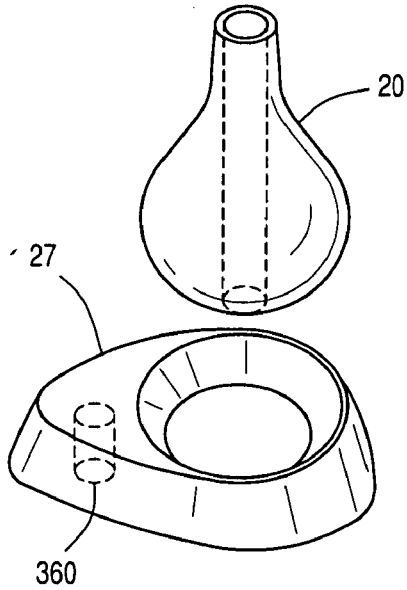
FIG. 3F
FIG. 3E
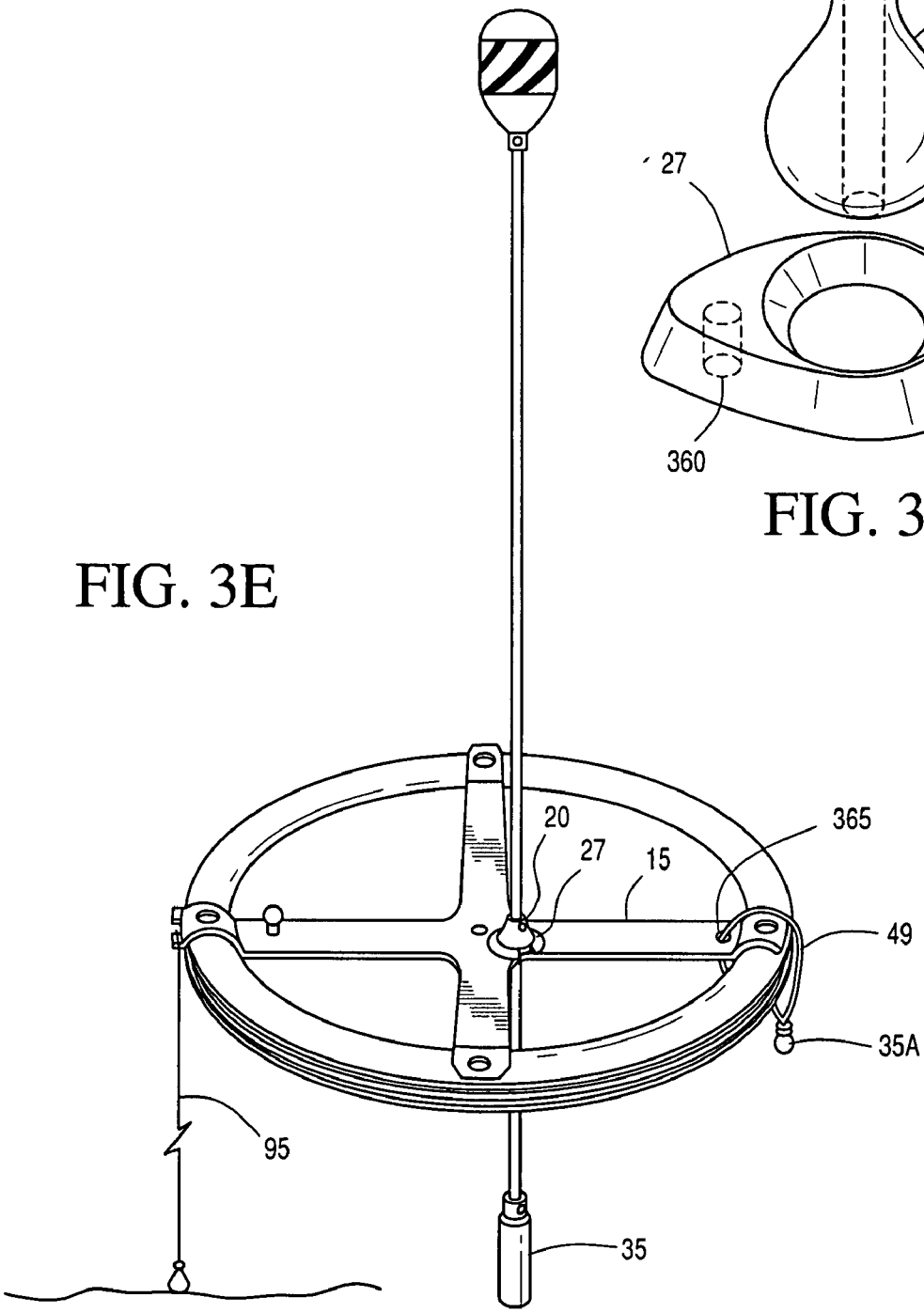

STEP 1

STEP 2

STEP 3

STEP 4

STEP 1

STEP 2

STEP 3

STEP 4

STEP 5

STEP 6

STEP 7

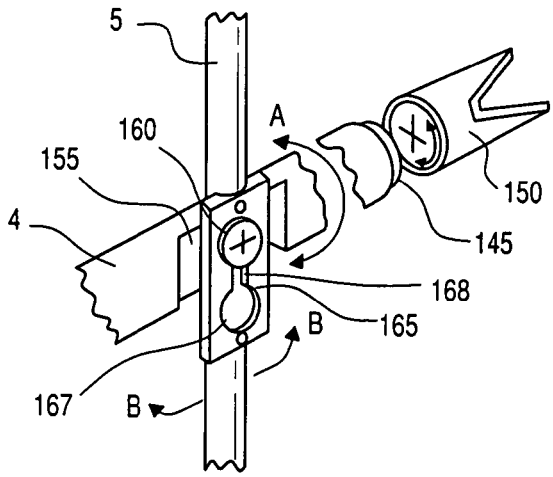
FIG. 13
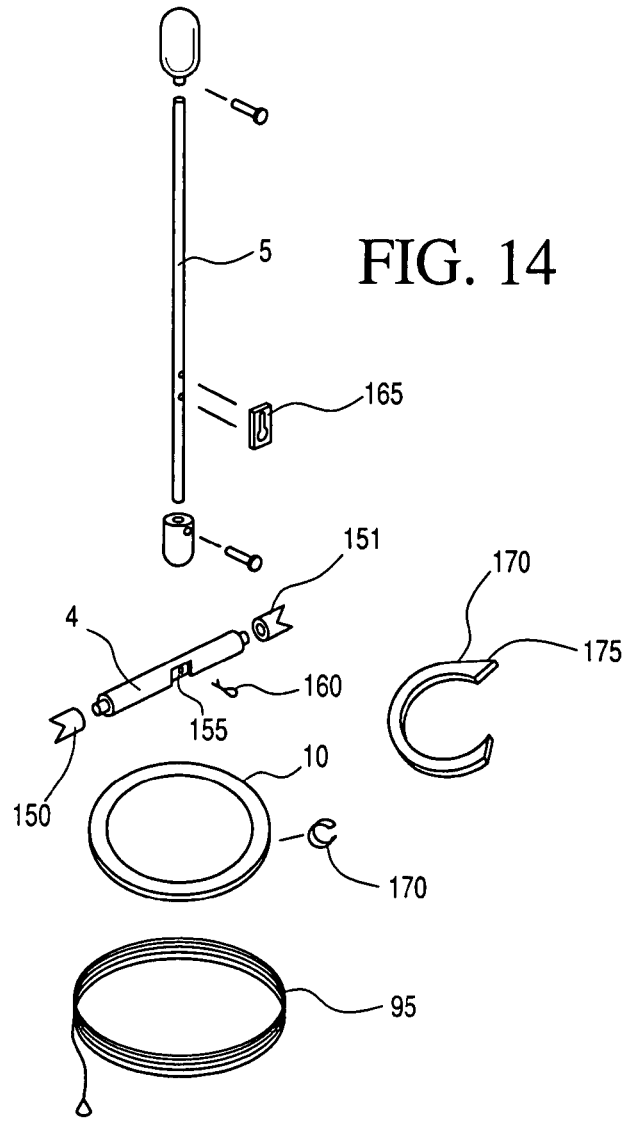
FIG. 14
FIG. 14A
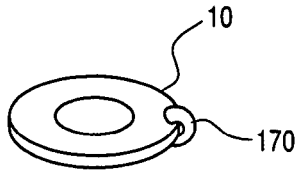

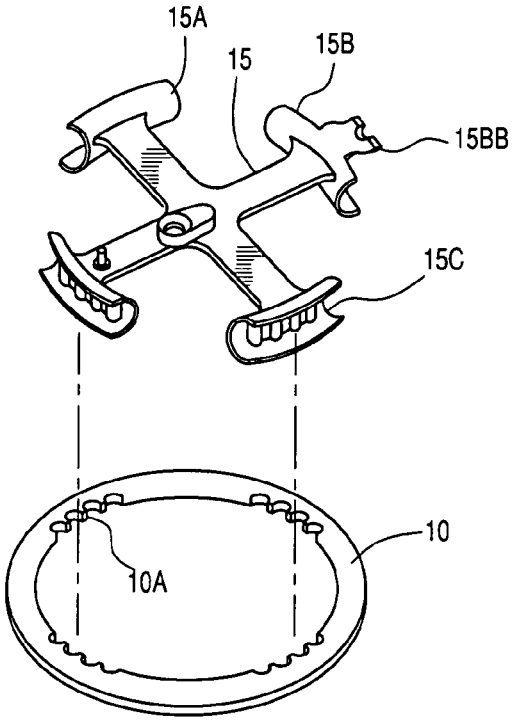
FIG. 18
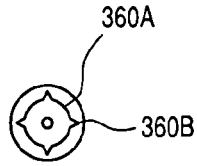
FIG. 19A
FIG. 19
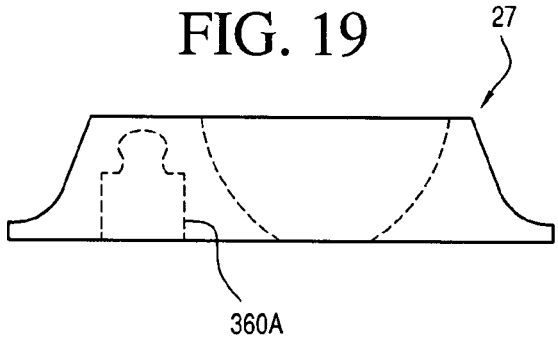
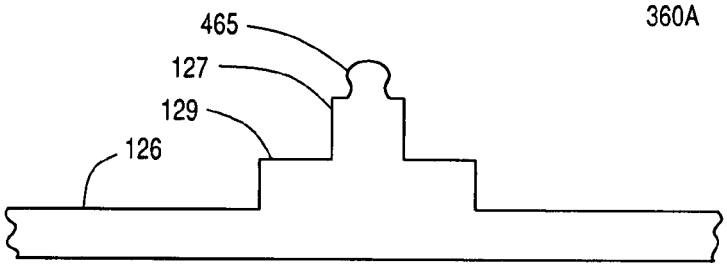
FIG. 20A
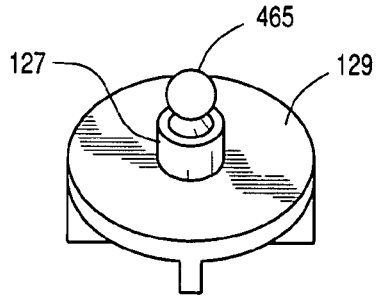
FIG. 20B

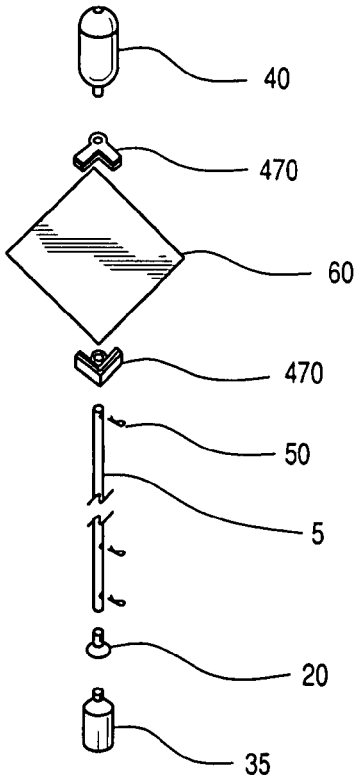
FIG. 21
FIG. 22A
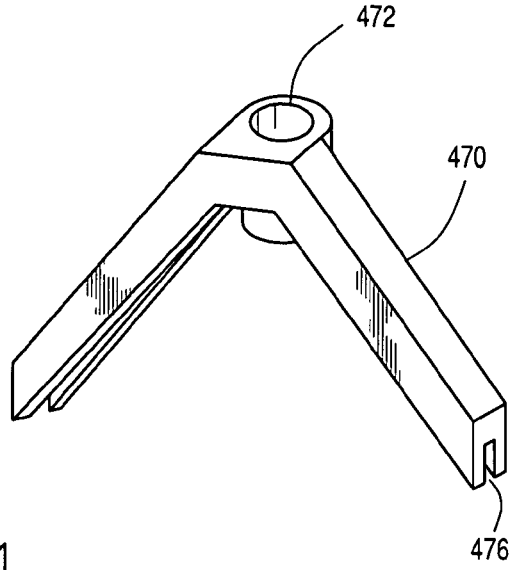
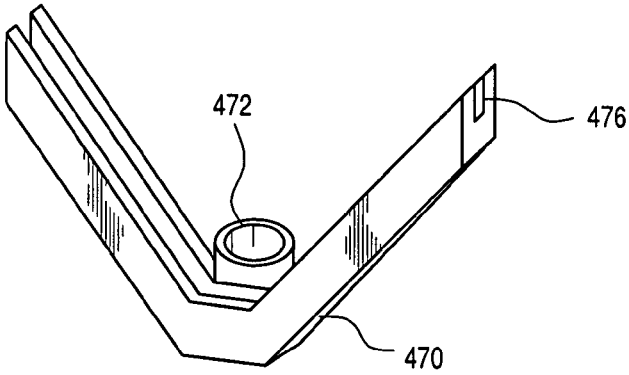
FIG. 22B

BUOY SYSTEM

REFERENCE TO RELATED APPLICATIONS

This application claims priority to U.S. Provisional Application 60/907,528 filed Apr. 6, 2007, to U.S. Provisional Application 60/817,580 filed Jun. 29, 2006 and to U.S. Provisional Application No. 60/814,297 filed Jun. 15, 2006.

FIELD OF THE INVENTION

The invention relates to floatable buoys which are utilized in marine environments to mark specific locations. More specifically, the invention relates to a portable marking buoy which may be easily disassembled for storage and reassembled for use and wherein the buoy includes signal devices which may include a light source that is supported by a float that is maintained in general vertical position by a depending weight assembly.

BACKGROUND OF THE INVENTION

Over the years there have been numerous types and styles of marine buoys designed to serve various functions. Marine buoys or floatable markers are not only used to define safe channels of passage through waterways but are also utilized to mark specific locations such as to identify specific fishing spots, traps for marine life including crab pots and lobster traps, or to mark specific subsurface locations so that such locations may be readily relocated for future research, investigation and/or testing.

Known portable buoys are not readily used because of various flaws in their designs. Although most known buoys automatically unwind an anchor line from a spool during deployment, retrieval of the buoys is time consuming. In addition, when known buoys are deployed in water with wave heights of about one foot or more, they tend to disappear from sight within the troughs of the waves. A need therefore exists for buoys which overcome the deficiencies of known buoys.

SUMMARY OF THE INVENTION

The invention relates to a buoy system. The buoy system includes a buoyant flotation reel 10, an anchor line 95 having an anchor weight 98 attached thereto, a reel insert 15 positioned within the interior of the buoyant flotation reel 10 and connected to the buoyant flotation reel 10, a display pole 5 having a pivot ball 20 thereon mounted within a socket component 27 mounted on the reel insert 15 wherein the socket component 27 is configured to enable the pivot ball 20 on the display pole 5 to move within the socket component 27 to enable the display pole 5 to move relative to the reel insert 15, and wherein the display pole 5 has attached thereon a ballast weight 35. The buoyant flotation reel 10 includes a groove 12 in the periphery thereof for retaining a length of anchor line 95. The buoy system may also include an anchor line drop line weight 115 for attachment to anchor line 95 distal to anchor weight 98. The reel insert 15 includes slot 112 for retaining drop line weight 115, and one or more message signs 60 for connection to display pole 5. The reel insert 15 includes hole 110 for receiving a winder 120 for turning of buoyant flotation reel 10. An additional ballast weight 35A may be connected to the buoyant flotation reel 10. The socket component 27 may include a hole 360 for receiving pin 127 on winder 120. The buoy system may include at least one of camera 450, light source 75 and ball 40 for connection to the top of display pole 5. Ball 40 may be formed of a buoyant material such as Styrofoam. Message sign 60 may be connected to display pole 5 by V-shaped holders 470. The buoy system also may include a winder 120 for attachment to reel insert 15 to enable retrieval of anchor line 95 onto buoyant flotation reel 10. The winder 120 includes a top 122, a base 124, and a midsection 126, where base 124 includes arms 130A, 130B, midsection 126 having a center pin 127 for engaging hole 110 of reel insert 15, and midsection 126 includes line guides 123 for guiding anchor line 95 onto floatation reel 10 during retrieval of anchor line 95.

In another aspect, the buoy system includes a buoyant flotation reel 10 in the form of a cylinder having an inner diameter and an outer diameter wherein the buoyant flotation reel 10 includes a groove 12 in the periphery thereof for receiving and retaining a length of anchor line 95, a support 4 located within the interior of buoyant floatation reel 10 and operatively connected to buoyant flotation reel 10 to enable support 4 to rotate downwardly relative to the top surface of reel 10, the support 4 having a recess for receiving a display pole 5 having a clip 165 for enabling attachment of display pole 5 to support 4 to enable display pole 5 to move in several directions relative to buoyant floatation reel 10.

The invention further relates to a kit for a buoy system. The kit includes a buoyant flotation reel 10 in the form of a cylinder having an inner diameter and an outer diameter wherein the buoyant flotation reel 10 includes a groove 12 in the periphery of the buoyant flotation reel 10 for receiving and retaining a length of anchor line 95, a length of anchor line 95, an anchor weight 98 for attachment to anchor line 95, a reel insert 15 for placement within the interior of the buoyant flotation reel 10 and for connection to the buoyant flotation reel 10, a display pole 5 having a pivot ball 20 thereon for mounting within a socket component 27 mounted on the reel insert 15 to enable the display pole 5 to move relative to the reel insert 15, and a ballast weight 35 for attachment to the display pole 5. The kit also may include a drop line weight 115 and one or more message signs 60 for mounting on display pole 5. The kit also may include a winder 120 for connection to buoyant flotation reel 10, as well as an additional ballast weight 35A for connection to buoyant flotation reel 10. The kit also may include at least one of a camera 450, a light source 75 and a flotation ball 40 for connection to the display pole 5 and one or more V-shaped holders 470 for connecting message sign 60 to display pole 5.

In another aspect, the kit for the buoy system includes a buoyant flotation reel 10 in the form of a cylinder having an inner diameter and an outer diameter wherein the buoyant flotation reel 10 includes a groove 12 in the periphery thereof for receiving and retaining a length of anchor line 95, a support 4 configured to be located within the interior of buoyant floatation reel 10 and for operative connection to buoyant flotation reel 10 to enable support 4 to rotate downwardly relative to the top surface of reel 10, connectors 150 for joining of support 4 to buoyant floatation reel 10, support 4 having a recess for receiving a display pole 5, and a clip 165 for enabling attachment of display pole 5 to support 4.

The disclosed buoy system includes a display pole that maintains a nearly vertical position relative to the water surface over a broad range of wind conditions and wave heights. The display pole may display message signs and may be equipped with a light source for night time illumination of the signs. The buoys may be used for a variety of applications such as marking of under water structures for fishing, posting "Diver Down" notices, and marking "Safe Zone" areas in deep water of depths of up to about 500 feet.

The buoy enables rapid dispensing of an anchor line from a buoyant flotation reel upon the deployment of the buoy in the water to insure the accurate marking of a location. When deployed in the evening hours, the buoy may include an electrically powered light source. The overall structure of the buoy is also designed to create a maintenance free and corrosive resistant structure which may be assembled and disassembled without tools.

BRIEF DESCRIPTION OF THE DRAWINGS

FIG. 3C is shows an alternative embodiment of the buoy system of FIG. 1;

FIG. 3D is an enlarged view of a rail section of the reel insert in the alternative embodiment of the buoy system of FIG. 3C;

FIG. 3E shows another alternative embodiment of the buoy system of FIG. 1 that employs an elongated socket component 27;

FIG. 3F shows an enlarged view of the ball and of the elongated socket component 27 shown in FIG. 3E;

FIG. 13 is a perspective view in partial cross-section of an alternative embodiment for enabling the display pole of the buoy system of FIG. 1 to pivot in a plurality of directions;

FIG. 14 is an exploded view of the alternative embodiment of FIG. 13;

FIG. 14A is a perspective view showing attachment of a line lock to the reel of the buoy system of FIG. 1;

FIG. 18 is an exploded view of an alternative embodiment of reel insert 15 and buoyant flotation reel 10;

FIG. 19 is a side view of the socket component of FIG. 3F having hole 360A configured for engagement of nipple 465;

FIG. 19A is a bottom view of hole 360A shown in FIG. 19;

FIGS. 20A, 20B show an alternative embodiment of center pin 127 of hub 129;

FIG. 21 is an exploded view showing message sign 60 mounted on its corners on display pole 5;

FIGS. 22A,22B show a perspective view of the holder for use in FIG. 21 where FIGS. 22A, 22B represent mirror images of the holder.

DETAILED DESCRIPTION OF THE INVENTION

Figure 1:
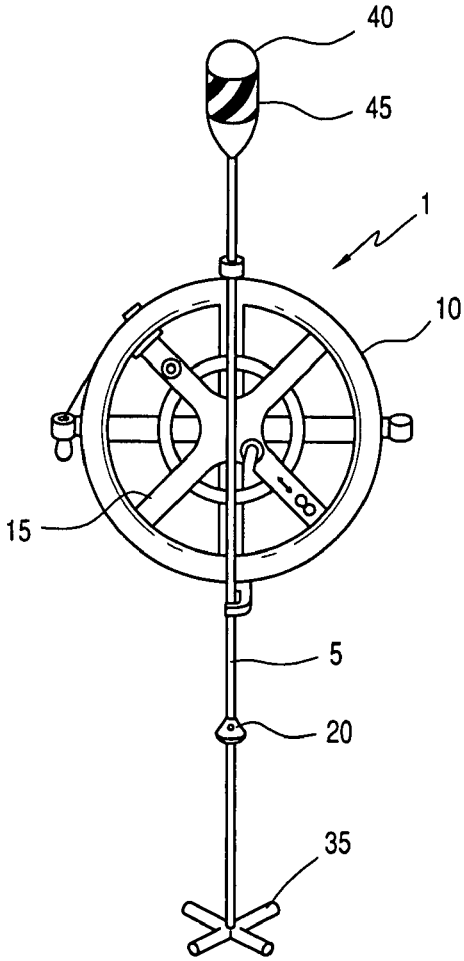
FIG. 1. is a front view of the buoy system in a stored configuration.
Figure 2:
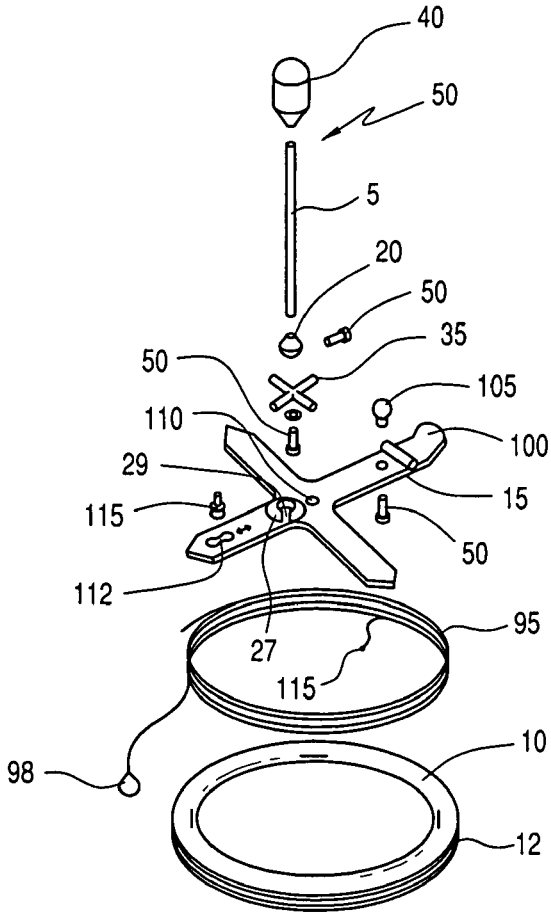
FIG. 2 is an exploded view of the buoy system of FIG. 1.
Figure 3B:
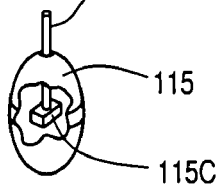
FIG. 3B is a cutaway view of the anchor line drop line weight 115 of the buoy system shown in FIG. 3.
Figure 3A:
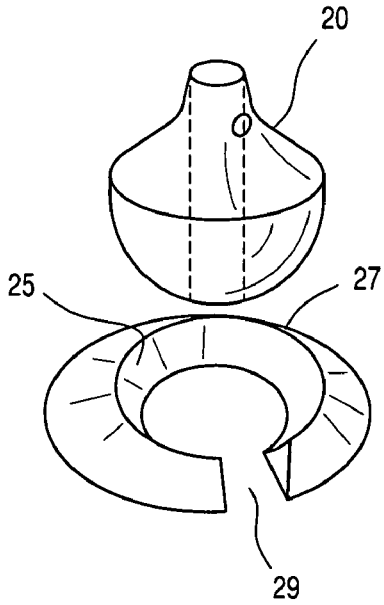
FIG. 3A is a detail view of the ball and of the socket component of the buoy system of FIG. 3 where socket component 27 includes access slot 29.
Figure 3:
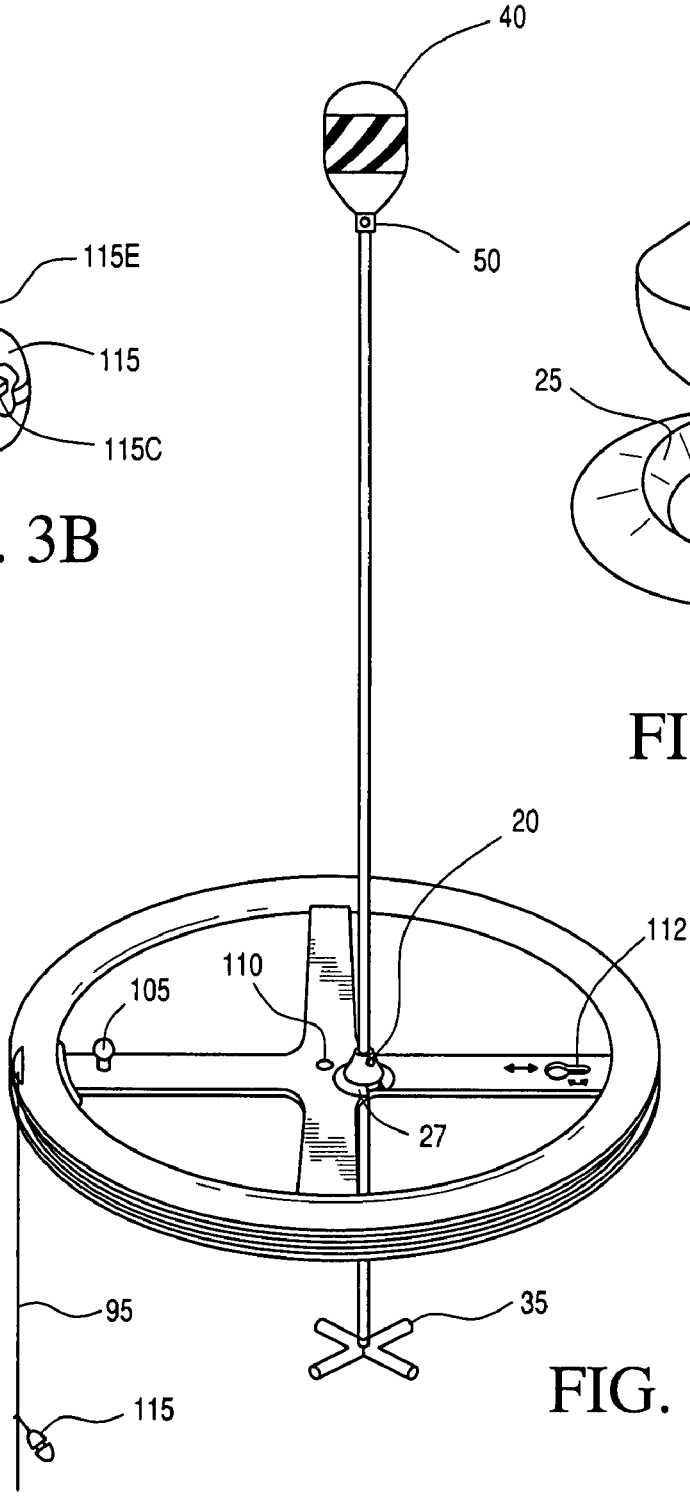
FIG. 3 is a top perspective in view of the buoy system of FIG. 1 that shows deployment of anchor line 95.

Buoy System 1 shown in FIGS. 1-7 includes display pole 5, floatation reel 10 and reel insert 15, all of which may be made by processes such as injection molding, such as injection molding of structural foams such as polyurethane and polyethylene. Marking bulb 40 formed of, such as, blow molded plastic or Styrofoam, may be attached to the top of display pole 5 and reflective tape 45 may be applied to bulb 40 as shown in FIG. 1. Display pole 5 may be solid or hollow and may be made of a wide variety of materials such as wood, aluminum, fiberglass and carbon-fiber. Located on display pole 5 distal to the top of display pole 5 is pivot ball 20. Pivot ball 20 is configured to freely move on interior surface 25 of socket component 27 as shown in FIGS. 3 and 3A.

Located at the bottom of display pole 5 is ballast weight 35. Ballast weight 35 may have a wide range of weights and a variety of shapes. Typically, ballast weight 35 has the shape of an "X" or a cylinder as shown in FIGS. 1 and 3C. Ballast weight 35 facilitates the ability of display pole 5 to maintain an upright position relative to the water surface. Marking bulb 40, pivot ball 20, and ballast weight 35 are retained on display pole 5 by fasteners 50 such as any of threaded screws and cotter pins which preferably are rust resistant.

As shown in FIGS. 4-7, one or more message signs 60,60A may be attached to display pole 5 by sign retaining clamps 55A-55D. Retaining clamps 55A-55D may have optional "V" shaped protrusions 71 in retaining slots 65A-65D, respectively, to engage message signs 60, 60A which may include optional "V" notches 70. Message signs 60,60A may be offset from the center line of display pole 5 to facilitate the ability of message signs 60,60A to move on display pole 5 in response to wind conditions. Retaining clamps 55B and 55C have offset notches 72 within their midsections. When retaining clamps 55B, 55C engage each other in a perpendicular configuration, offset notches 72 aid in maintaining message signs 60,60A perpendicular to each other as in FIG. 5. When retaining clamps 55B and 55C engage each other in a parallel configuration as in FIG. 6, they aid in maintaining message signs 60,60A in a parallel configuration.

Figure 5:
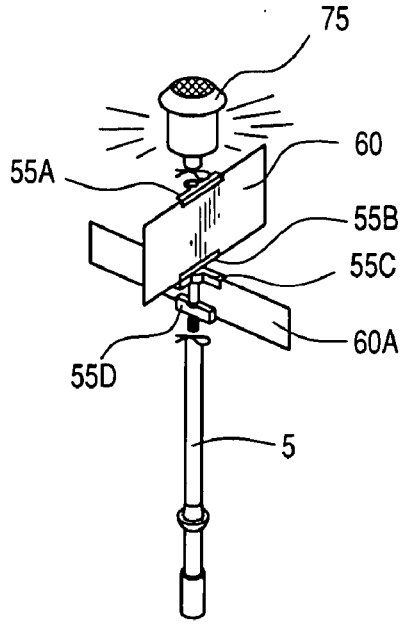
FIG. 5 is a perspective view of the buoy system of FIG. 1 equipped with a solar powered light source.
Figure 6:
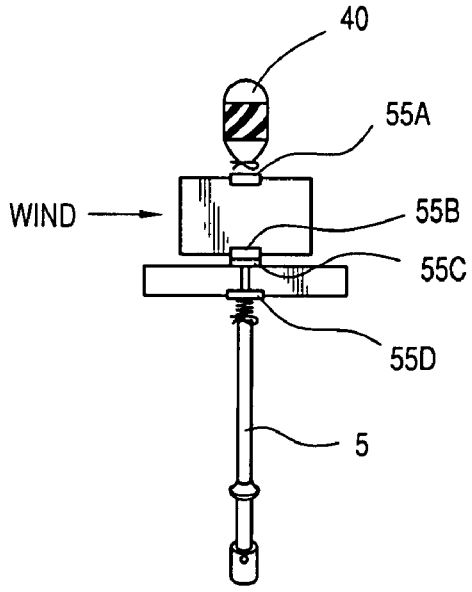
FIG. 6 is a front view of the buoy system of FIG. 4 showing a display pole equipped with a bulb having reflective tape and message signs in a parallel configuration.
Figure 7A:
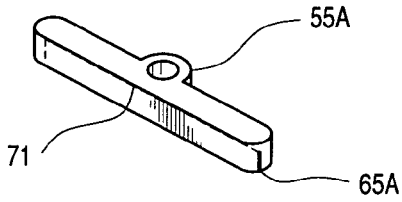
FIGS. 7A-7D are perspective views of message sign retaining clamps.
Figure 7B:
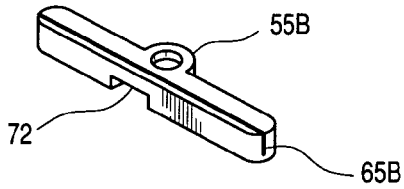
Figure 7C:
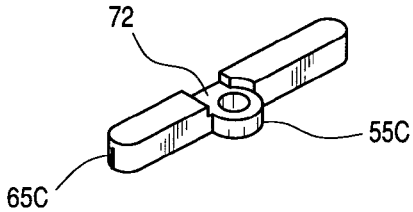
Figure 7D:
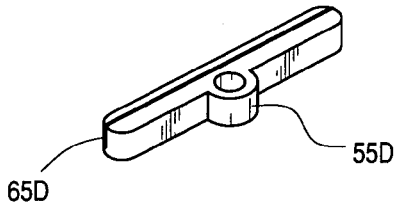

Solar powered light source 75 shown in FIG. 5 for nighttime illumination of message signs 60,60A may be substituted for marking bulb 40. Solar powered light source 75 may be in the form of a solar powered night-light and may include a commercially available luminous "volume-to-degree of-darkness" switch. Useful solar powered lights include Landscape Accent Lighting Model 498959 from Hampton Bay Co.

Figure 4:
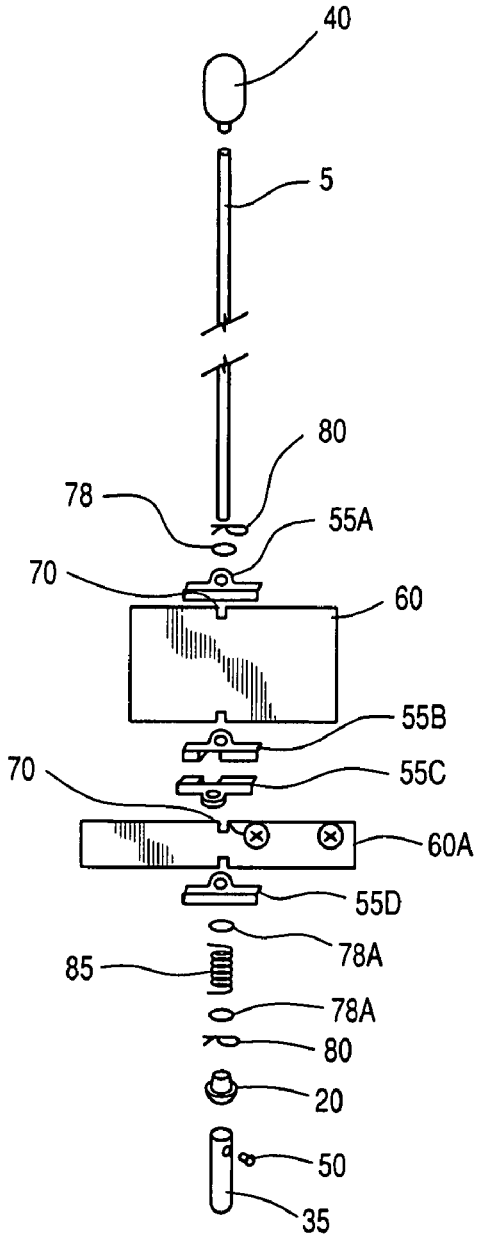
FIG. 4 is an exploded view of the Buoy System of FIG. 1 that includes message signs.

Hitch-Pin 80, as shown in FIG. 4, is located adjacent upper washer 78 formed of, such as, nylon to limit upward movement of message signs 60,60A on display pole 5. Upper retaining clamp 55A is maintained on display pole 5 below hitch pin 80 and engages the top of upper message sign 60. Upper middle sign retaining clamp 55B, mounted below message sign 60 on display pole 5, engages the bottom of upper message sign 60. Lower middle sign retaining clamp 55C, after mounting on display pole 5 below upper message sign 60 may engage upper middle sign retaining clamp 55B in a parallel or perpendicular configuration. In doing so, the bottom of lower middle sign retaining clamp 55C engages the top of lower message sign 60A as shown in FIG. 4. Lower sign retaining clamp 55D, after mounting on pole 5 below sign 60A engages the bottom of sign 60A. Below lower sign retaining clamp 55D is located lower washer 78A such as of nylon that may be identical to upper washer 78. Beneath lower washer 78A is spring 85 formed of, such as, stainless steel, to aid in maintaining the positions of signs 60,60A relative to each other at a desired location on pole 5.

Located under spring 85 are a second washer 78A and a second hitch-pin 80 for retaining spring 85 at a desired location on display pole 5. Positioned on display pole 5, typically at a point about ⅔rds of the length of display pole 5 from the top of display pole 5, is ball 20 for engaging socket 27. At the bottom of display pole 5 is ballast weight 35.

Figure 2A:
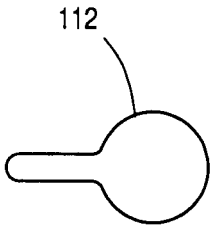
FIG. 2A is an enlarged view of slot 112 in reel insert 15 shown in FIG. 2.

Floatation for Buoy System 1 may be provided by cylindrical, preferably donut shaped floatation reel 10 made of buoyant materials such as Styrofoam and polyethylene foam. The periphery of floatation reel 10 includes takeup groove 12 as shown in FIG. 2 for receiving and retaining anchor line 95. Anchor line 95 may be water absorbing line such as 50 Lb. test braided Dacron manufactured by Woodstock Mfg. Co. Use of a water absorbing material as anchor line 95 may facilitate positioning of buoy 1 without the need for drop line weight 115 that is shown in FIG. 3. One end of anchor line 95 includes anchor weight 98 as shown in FIG. 2. Another portion of line 95 is attached to drop line weight 115. Drop line weight 115 as shown in FIG. 3B has a generally cylindrical configuration with a reduced diameter mid section for engaging slot 112 in reel insert 15 shown in FIGS. 2, 2A and 3.

Drop line weight 115 is of unitary construction and has a wire running through its center for attachment to anchor line 95. The wire extends through the vertical axis of weight 115. The top of the wire is configured to form a clip such as clip 115E as shown in FIG. 3B. Drop line weight 115 provides a counterbalance while winding floatation reel 10 and reduces the likelihood of possible entanglement of anchor line 95.

Reel insert 15, as shown in FIGS. 2 and 3, generally may be in the form of an "X" for insertion into the center portion of floatation reel 10. One member of reel insert 15, as shown in FIG. 2, may include line lock 100 into which anchor line 95 may be secured. Turn knob 105 attaches to reel insert 15 to enable cranking of floatation reel 10 in both clockwise and counterclockwise directions. Fastener 50 such as a screw passes through reel insert 15 to secure turn knob 105 to reel insert 15. Pivot hole 110 in reel insert 15 facilitates alignment with winder 120 to facilitate winding of floatation reel 10 on winder 120 during retrieval of anchor line 95.

Located distal to pivot hole 110 on reel insert 15 is socket component 27 that has access slot 29 as shown in FIGS. 2 and 3A. Display pole 5 having ball 20 thereon may be passed through slot 29 to place ball 20 on display pole 5 into socket component 27 on interior bearing surface 25. Opposite the end of reel insert 15 that includes line lock 100 is slot 112 for retaining drop line weight 115. Slot 112 may be teardrop shaped as shown in FIG. 2A and FIG. 3. Drop line weight 115 may be made of various materials such as lead or steel. Drop line weight 115 may be locked within slot 112 by rotating rectangular section 115C thereof against a narrower portion of slot 112.

Figure 8:
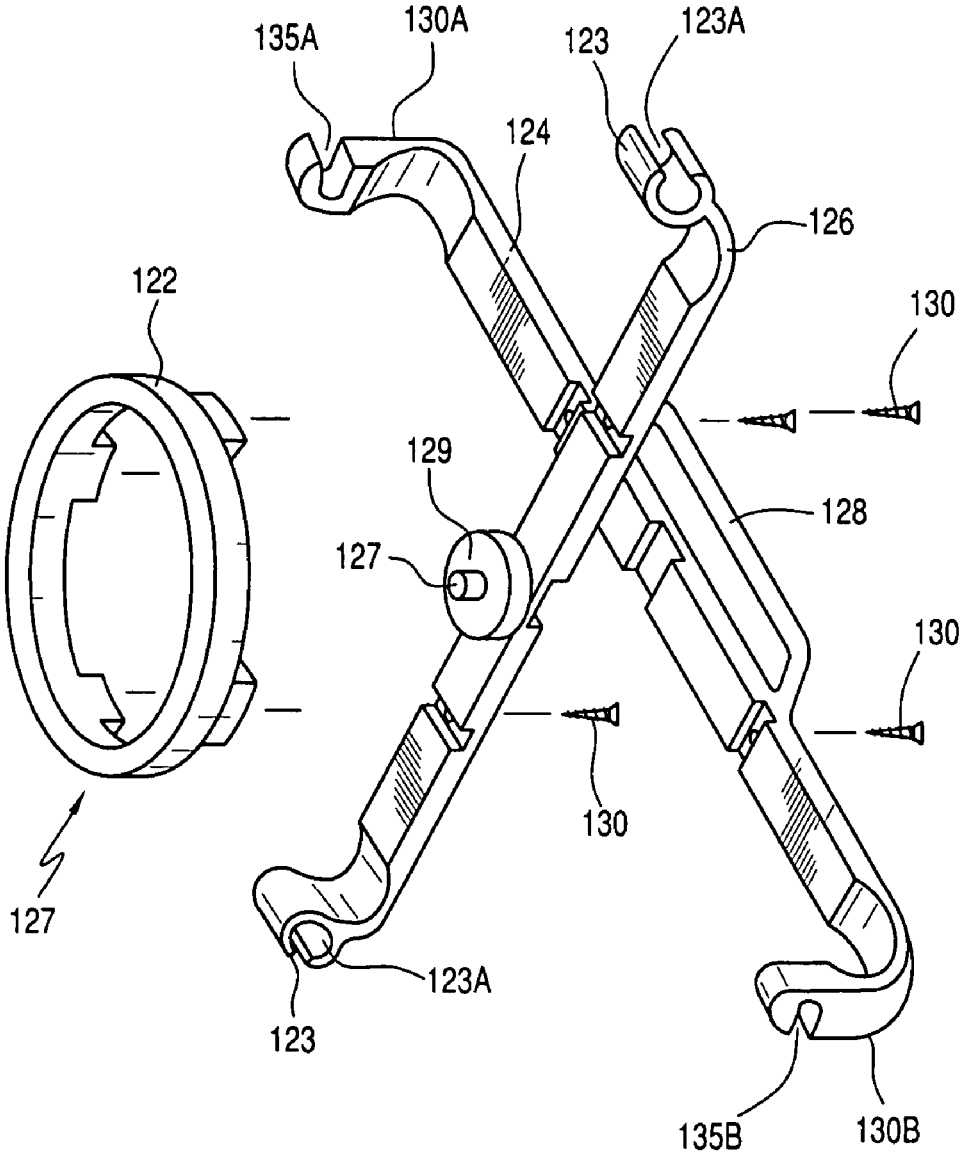
FIG. 8 is an exploded view of the winder of the buoy system of FIG. 1.

Winder 120 as shown in FIG. 8 includes top 122, base 124, and midsection 126 components. These components may interlock and may be joined together with fasteners 130 such as screws. Base 124 includes handle 128 and arms 130A, 130B which have in line or reverse notches 135A, 135B, respectively, to engage display pole 5 for storage as seen in FIG. 1. Midsection 126 includes center hub 129 to aid in stabilizing floatation reel 10 during winding of anchor line 95 onto floatation reel 10. Center pin 127 extends upwardly from hub 129 to engage hole 110 of reel insert 15 as in FIG. 9. At either end of midsection 126 are line guides 123 which have slots 123A for receiving and guiding anchor line 95 onto floatation reel 10 when floatation reel 10 is turned during retrieval of anchor line 95. Top 122 of winder 120 is located beneath reel insert 15 while cranking turn knob 105 to turn floatation reel 10 as in FIG. 10. A user may hold handle 128 of winder 120 while holding reel insert 15 when preparing to retrieve anchor line 95.

Figure 8A:
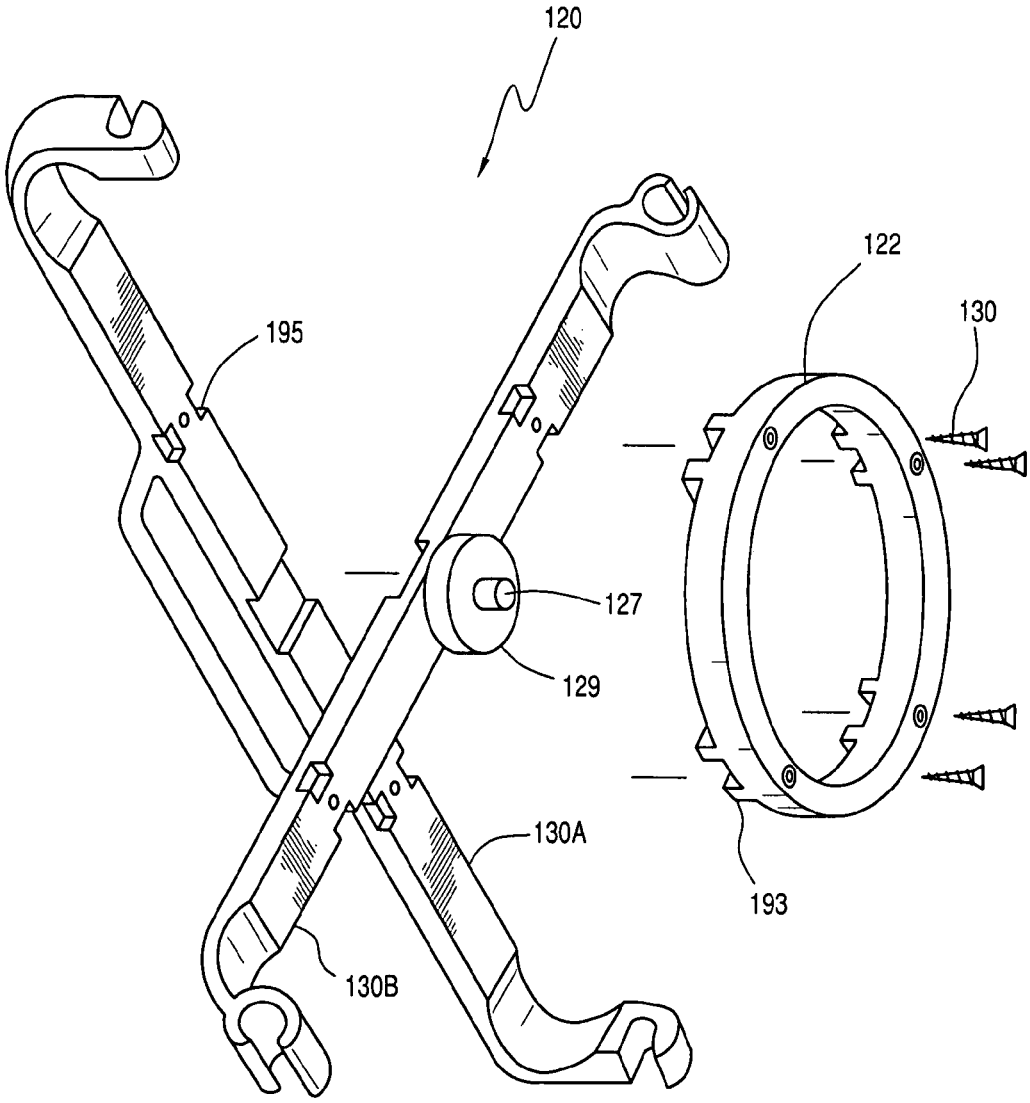
FIGS. 8A and 8B are exploded views of alternative embodiments of the winder of the buoy system of FIGS. 1 and 9.
Figure 8B:
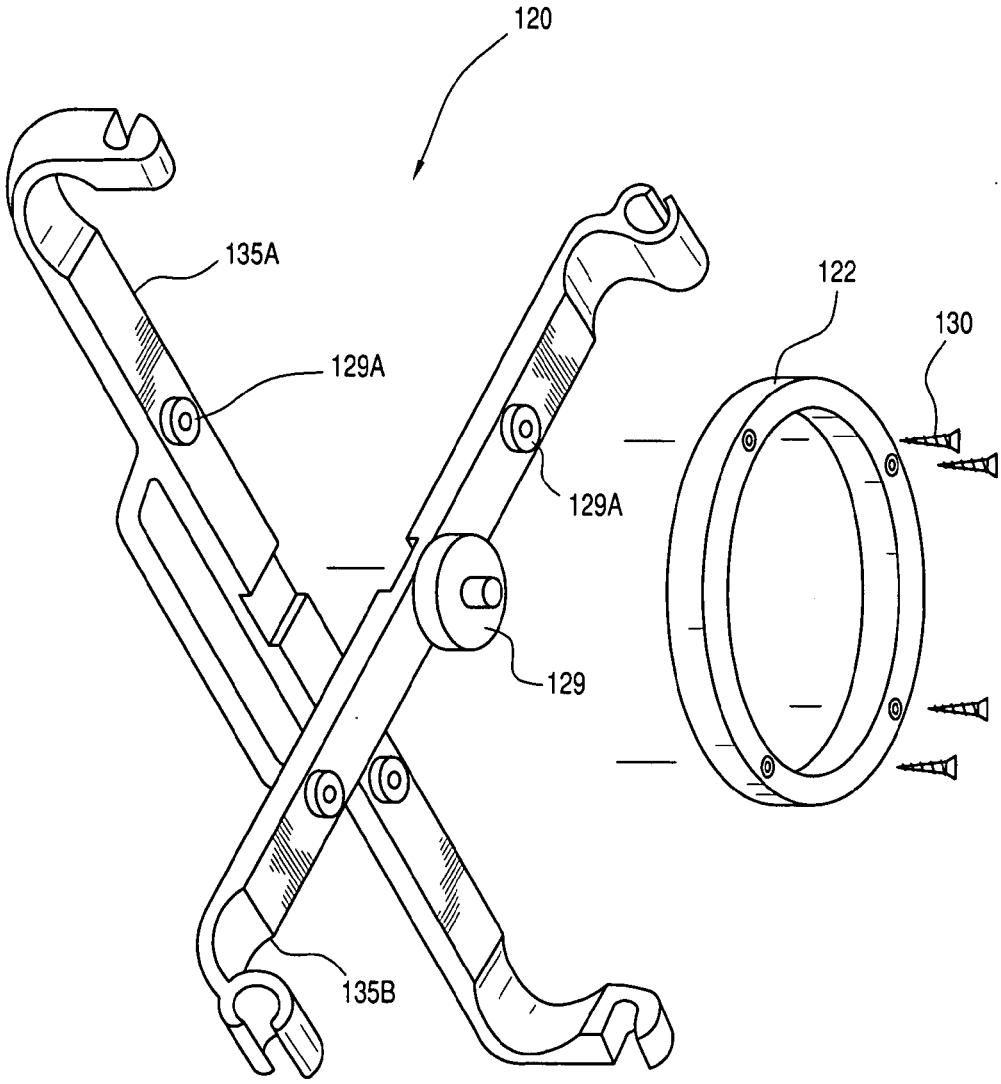

In a first alternative embodiment of winder 120 as shown in FIG. 8A, arms 130A, 130B each may include a plurality of adjacent recesses 195 configured to engage adjacent leg portions 193 of top 122. Top 122 may be secured to arms 130A, 130B by fasteners 130 such as screws. In a second alternative embodiment of winder 120 as shown in FIG. 8B, arms 135A, 135B each may include pads 129A. Pads 129A which may be made of materials such as felt, wood and plastics such as polypropylene and polyethylene, engage top 122 and receive fasteners 130 which pass through top 122.

In an alternative embodiment buoy 1, as shown in FIG. 3C, reel insert 15 may extend over the top surface of buoyant flotation reel 10 and may be attached to floatation reel 10 by spikes 400 such as "shutter-Loks" from Architectualdepot.com. Reel insert 15 may include vertical raised rails 405 as shown in FIG. 3D. Rails 405 may be formed of plastic such as polypropylene. Rails 405 may provide for raised seat 345 as shown in FIG. 3D for receiving screw 107 upon which turn-knob 105 may rotate. Reel insert 15 may include hole 365 opposite anchor line 95 to enable securing of additional ballast weight 35A by strap 49.

Figure 3G:
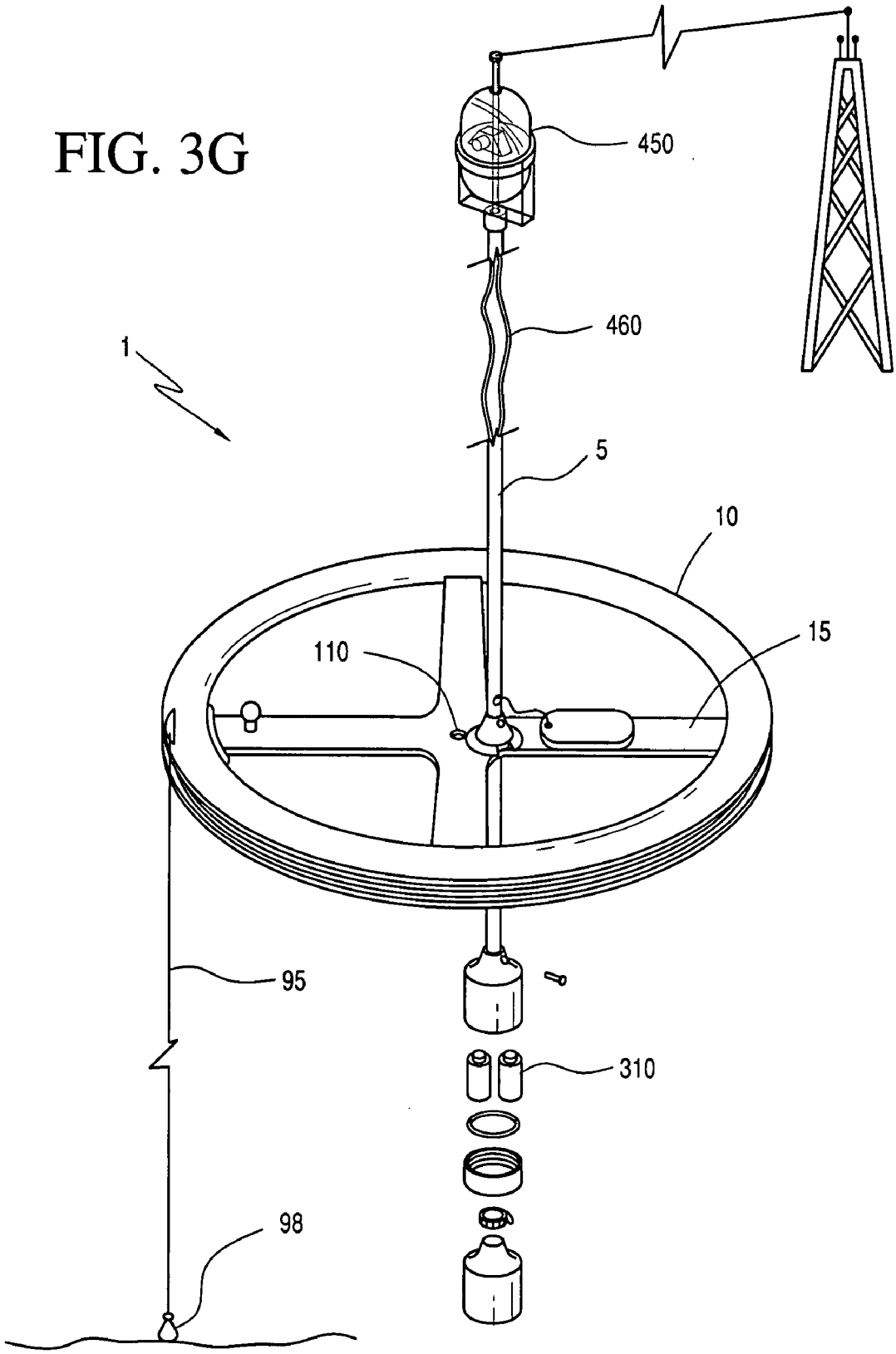
FIG. 3G shows an alternative embodiment of the buoy system of FIG. 1 that employs a surveillance camera.

In a second alternative embodiment of the buoy system as shown in FIGS. 3E, 3F and 3G, socket component 27 of reel insert 15 forms a continuous circle for receiving ball 20 on display pole 5. Socket component 27 preferably is elongated towards the center of reel insert 15 to extend over hole 110 in reel insert 15. In this embodiment, socket component 27 includes hole 360 for center pin 127 on winder 120 to enable winder 120 to connect to reel insert 15 for retrieval of anchor line 95. Socket component 27 of reel insert 15 may be enclosed where it is desired to prevent disengagement of display pole 5 from reel insert 15.

In a third embodiment of the buoy system as shown in FIG. 3G, buoy 1 may be configured to enable "on-the-water" camera surveillance. In this aspect, a remote camera 450 such as E-Buck remote-monitored digital game camera, model #38-886-183-00, available at Bass Pro Shops, may be affixed to display pole 5 and may be powered by batteries 310 connected to camera 450 by wires 460 housed in display pole 5.

In yet another aspect of the buoy system, as shown in FIG. 18, reel insert 15 includes elongated end members 15A and 15B. End members 15A,15B include teeth 15C for engaging grooves 10A in buoyant flotation reel 10. One or more of end members 15A, such as member 15B, may include anchor line tie 15BB for securing anchor line 95 when anchor line 95 is deployed.

In another aspect of winder 120, as shown in FIGS. 19, 20A and 20B, center pin 127 of hub 129 is configured to include nipple 465. In this aspect, nipple 465 engages hole 360A in socket component 27 when winder 120 is joined to reel insert 15. Hole 360A includes slots 360B which may extend for a portion of or for the entire depth of hole 360A. In use, winder 120 having center pin 127 that includes nipple 465 engages hole 360A to secure winder 120 to reel insert 15 to enable retrieval of anchor line 95.

In another embodiment of the buoy system, as shown in FIGS. 13, 14 and 14A, display pole 5 is enabled to pivot in several directions to maintain a vertical or nearly vertical position while floatation reel 10 floats on the surface of the water. In this aspect, ends 145 of support 4 engage connectors 150. Support 4 having recess 155 located on the diameter of floatation reel 10. Support 4, having connectors 150 thereon, is inserted into floatation reel 10 after floatation reel 10 is expanded such as by manual stretching to elongate its inner diameter. When released, floatation reel 10 returns to its original diameter to cause connectors 150 on support 4 to engage floatation reel 10 and to enable support 4 to turn freely in the direction of arrows A-A. Connectors 150 may be made by cutting a tube such as polyethylene to produce a pair of diagonal sections for insertion into floatation reel 10. Pole 5 is attached to support 4 in recess 155. Pole 5 has thereon clip 165 that includes receiving hole 167. Hole 167 receives headed pin 160 to secure clip 165 to pole 5. Engagement slot 168 of clip 165 adjoins receiving hole 167 and receives the shaft of headed pin 160 that passes through display pole 5. In this embodiment, display pole 5 may move freely left and right in the direction of arrows B-B on pin 160 and support 4 may rotate forward and backwards in the direction of arrows A-A. Line lock 170 formed of, such as plastic may be secured to the outer periphery of floatation reel 10 as in FIG. 14A. One end of lock 170 includes tapered line lock notches 175 configured to receive and secure anchor line 95.

Figure 9:
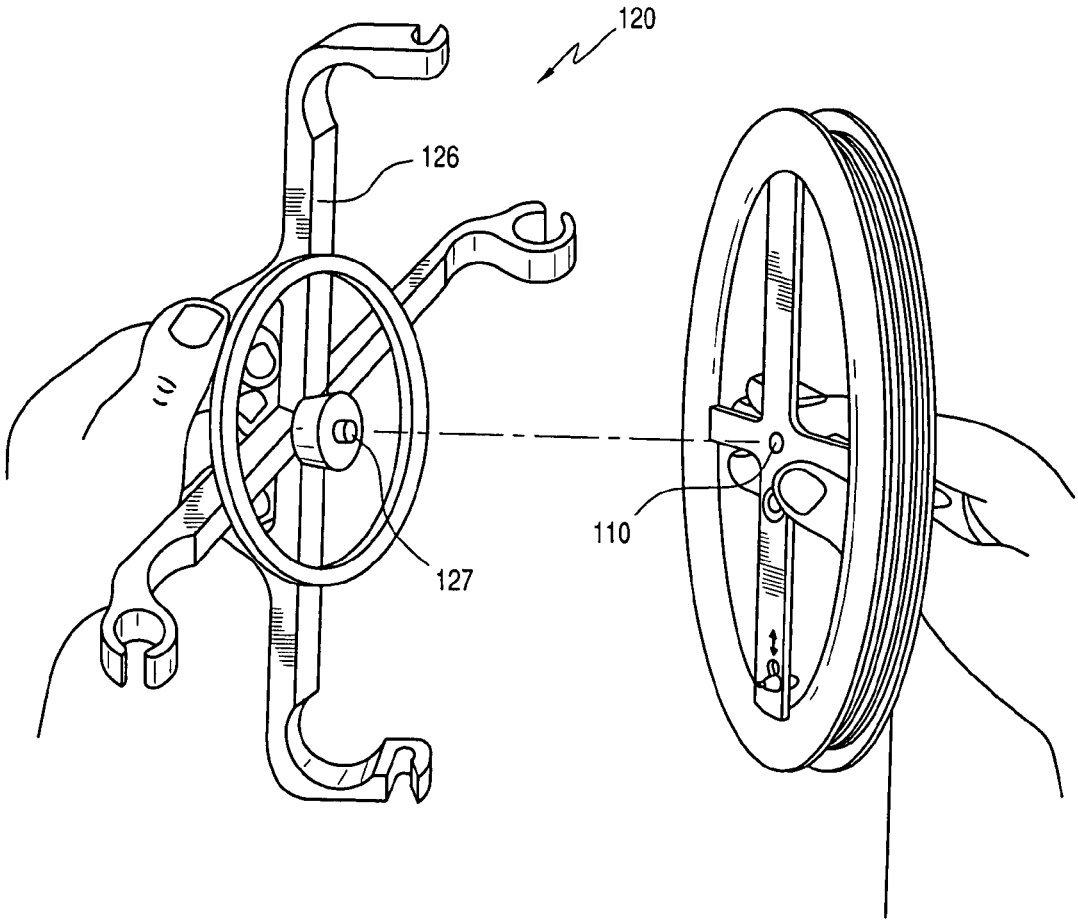
FIG. 9 illustrates aligning the winder and buoyant flotation reel of the buoy system of FIG. 1.
Figure 10:
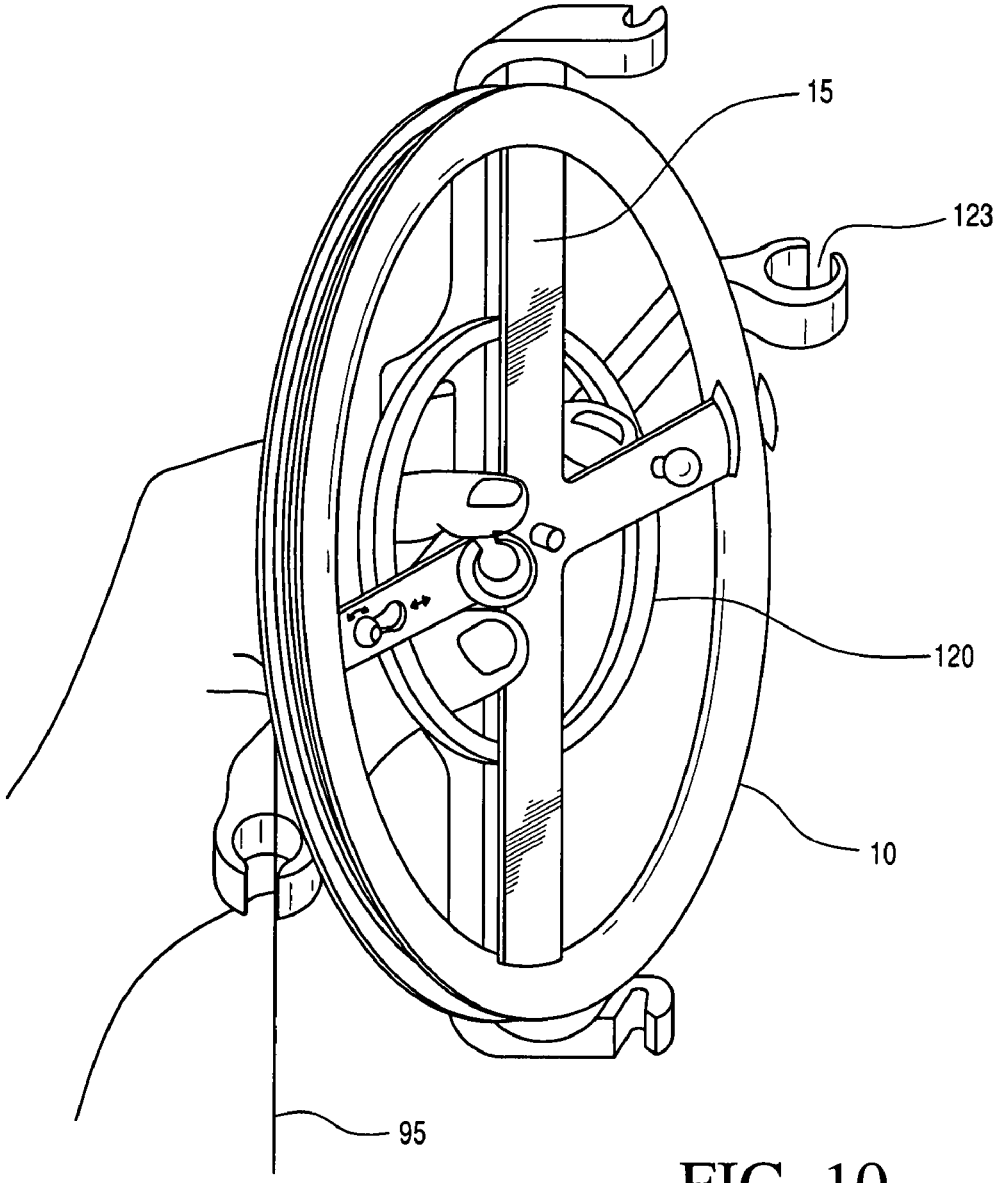
FIG. 10 is a perspective view of the assembled winder and the reel of buoy system of FIG. 1.
Figure 11A:
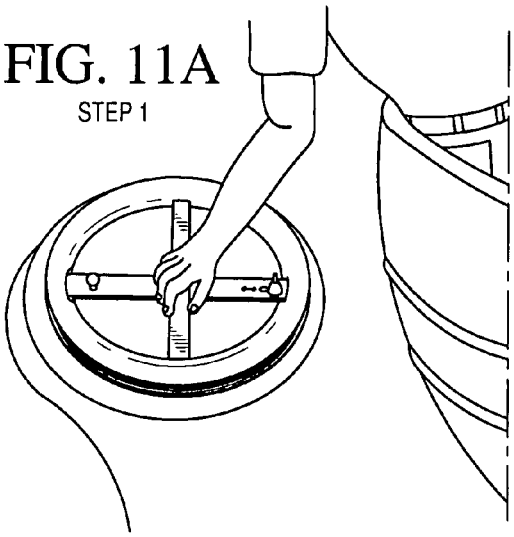
FIGS. 11A-11D illustrate steps in deployment of the buoy system of FIG. 1.
Figure 11B:
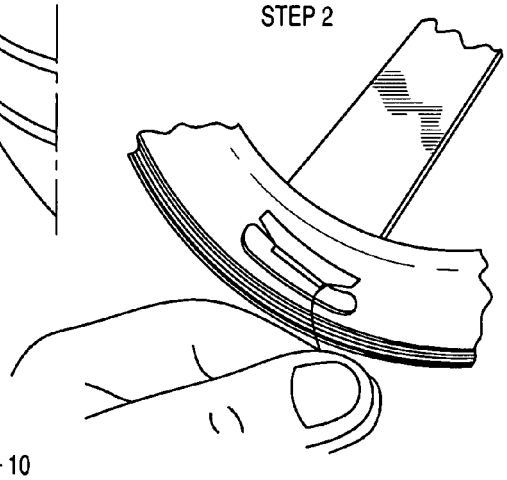
Figure 11C:
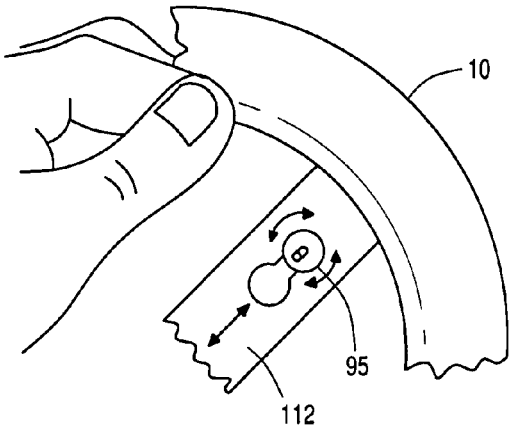
Figure 11D:
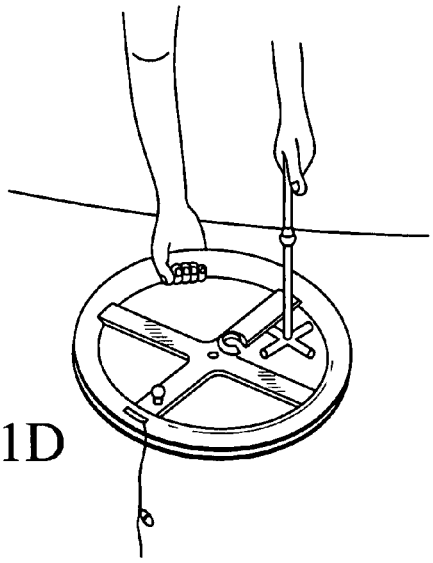
Figure 12A:
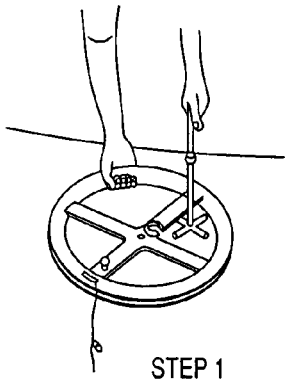
FIGS. 12A-12G illustrate steps in retrieving the buoy system of FIG. 1.
Figure 12B:
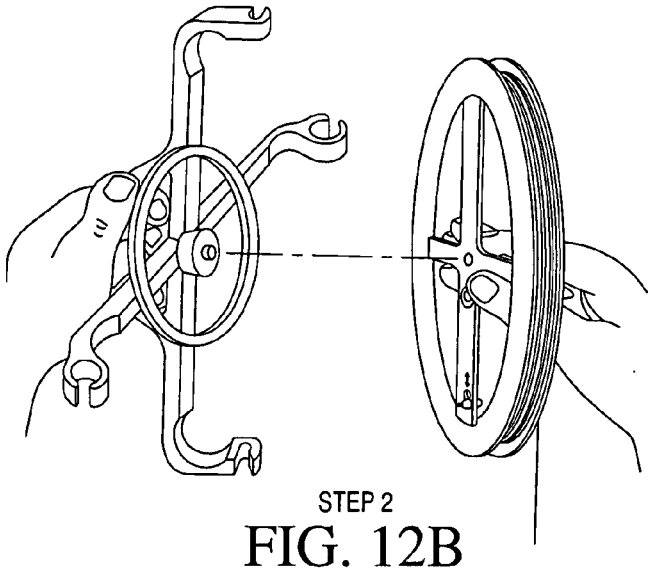
Figure 12C:
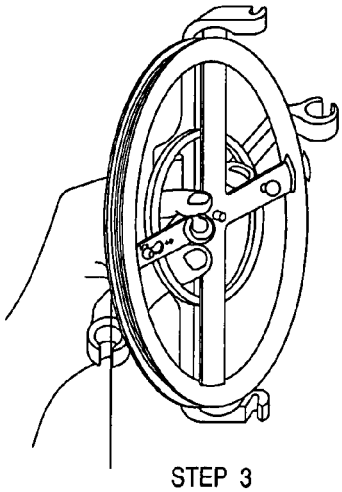
Figure 12D:
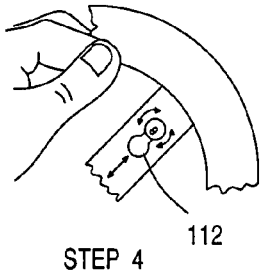
Figure 12E:
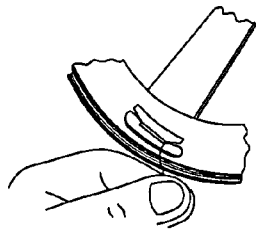
Figure 12F:
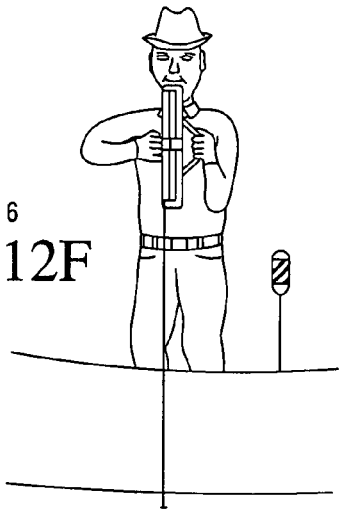
Figure 12G:
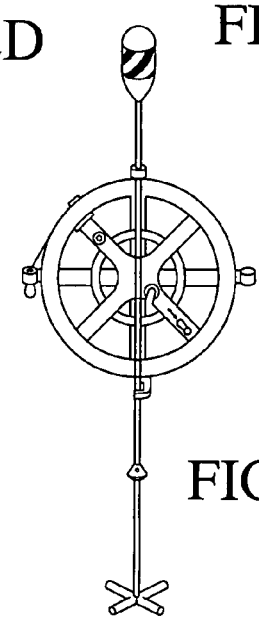
Figure 15:
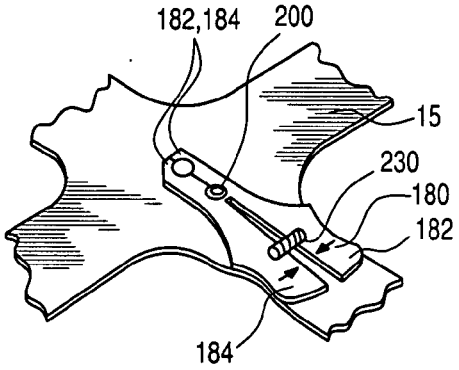
FIG. 15 is a top perspective view of a portion of the reel insert of the buoy system of FIG. 1 showing a reel clamp for securing the reel to the winder.
Figure 16:
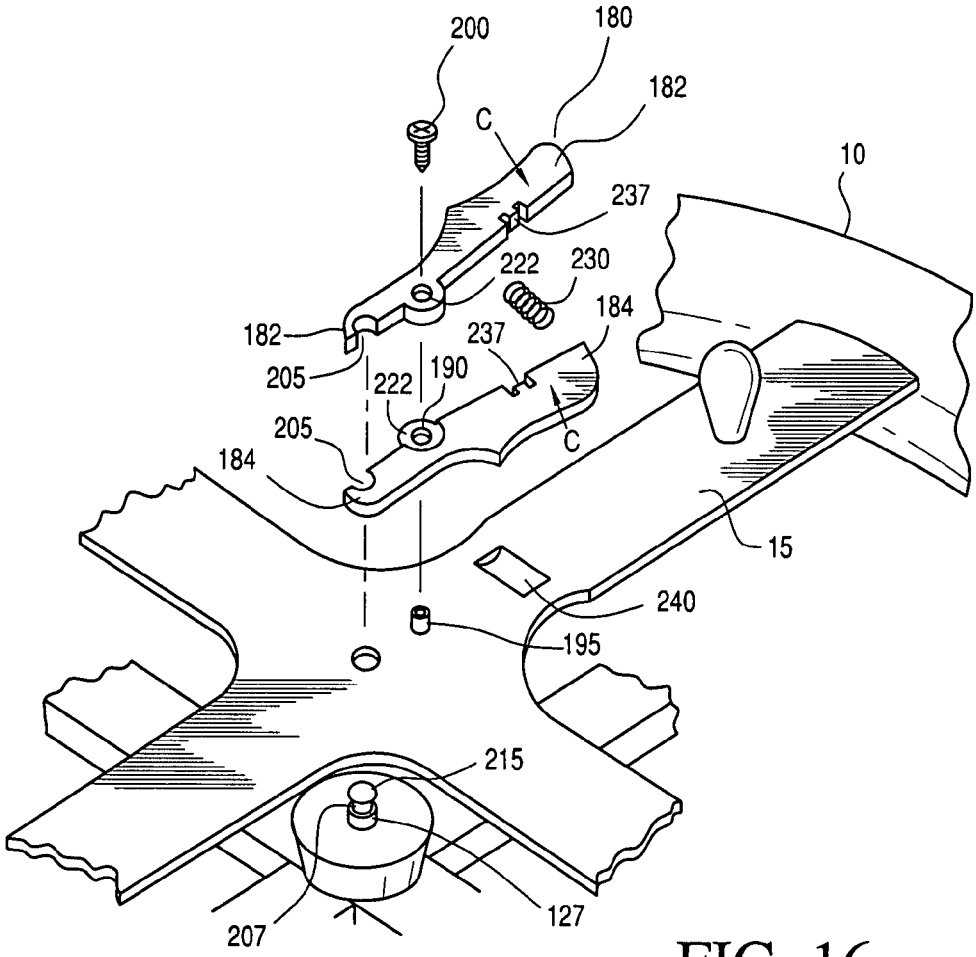
FIG. 16 is an exploded view of the reel clamp of FIG. 15 and partial section of the reel insert and of the winder of the buoy system.

During retrieval of anchor line 95, floatation reel 10 may be retained on winder 120 as shown in FIGS. 9, 15 and 16 by spring loaded reel clamp 180 attached to reel insert 15. Reel clamp 180 includes body halves 182,184 which preferably are mirror images of each other and are installed in an inverted position relative to each other as seen in FIG. 16. Center holes 190 of halves 182, 184 align with each other and engage pivot pin 195 protruding from reel insert 15. Halves 182,184 are secured onto reel insert 15 by fastener 200. Fastener 200, which may be a threaded screw, engages pivot pin 195 to secure halves 182,184 in alignment on pine 195. Flanges 222 in body halves 182,184 typically are about half the thickness of body halves 182,184. Pressure on halves 182,184 generated by spring 230 as shown by arrows C-C separates retaining jaws 205 from indent 207 on center pin 127 on winder 120 as shown in FIGS. 8, 9 and 16. Compression spring 230 engages spring slots 237, as shown in FIGS. 15 and 16, to compress retaining jaws 205 against indent 207 of center pin 127. Floatation reel 10 thus may stay on winder 120 until reel clamp 180 is released from pin 127 that has rounded head 215. Optional relief notch 240 may be provided in reel insert 15 to enable spring 230 to ride in a lower position with body halves 182,184.

Figure 17:
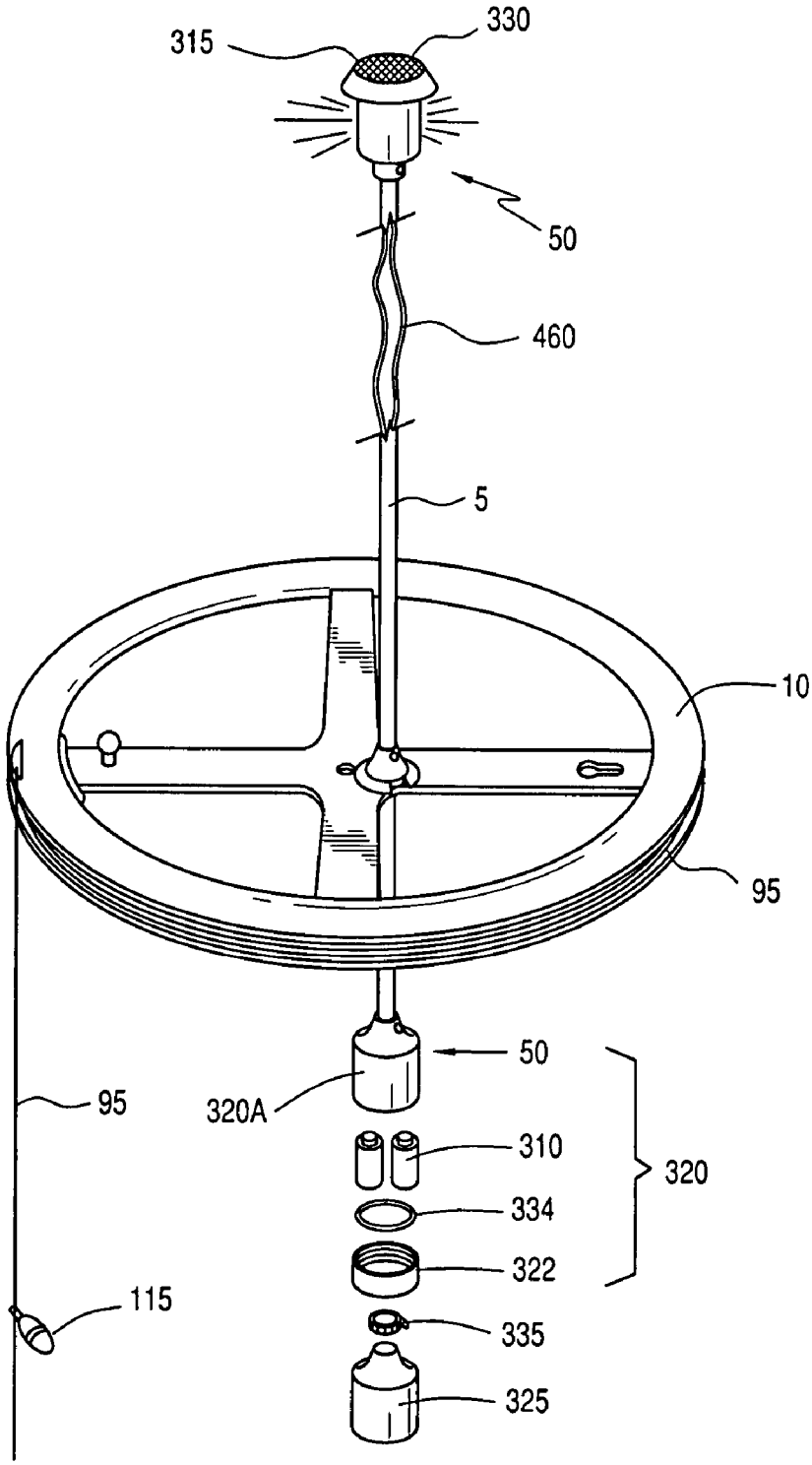
FIG. 17 shows an alternative embodiment of the buoy system that employs a solar-battery powered light source.

In another embodiment of the buoy system, a battery equipped solar powered light 315 replaces bulb 40 on display pole 5. As seen in FIG. 17, battery housing 320 for retaining one or more batteries 310 is attached to the bottom of display pole 5 by fastener 50 such as a screw or cotter pin. Housing 320 includes upper receiver 320A and lower cap 322. Housing receiver 320A and lower cap 322 are configured to engage each other and preferably are threaded. Display pole 5 may be a hollow shaft formed of materials such as aluminum, fiberglass or carbon fiber. Through the interior of display pole 5 are wires 460 that transfer electricity from solar charging panel 330 to charge batteries 310 in housing 320 during daylight hours. During low light and night time hours a light sensitive switch such as Hampton Bay Co. Model 498959 in light 315 functions to enable electricity to pass from batteries 310 to the bulb in solar powered night light 315.

Housing 320 may be made waterproof by rubber gasket 334 between housing receiver 320A and lower cap 322. Boot 325 may also be used to waterproof battery housing 320. Boot 325 may be made of a flexible rubber or plastic that can be stretched and pulled to encapsulate battery housing 320. Adjustable hose clamp 335 formed of, such as, stainless steel may be used to secure boot 325 to housing 320.

In yet another embodiment as shown in FIGS. 21, 22A and 22B, message sign 60 may be mounted at its corners on display pole 5 by holders 470. Holders 470 include hole 472 for engaging pole 5. Holders 470 may be secured to pole 5 by fasteners 50. Holders 470 include slots 476 for engaging message sign 60.

Deployment

As shown in FIG. 11A-11D, deployment of buoy system 1 into water entails first holding floatation reel 10 at a desired angle to the water's surface to enable drop line weight 98 on anchor line 95 to fall below the water surface to unwind anchor line 95 from floatation reel 10. If anchor line 95 becomes slack, a portion of anchor line 95 may be wrapped around line lock 100 on reel insert 15.

A length of anchor line 95 then may be passed under clip 115E of drop line weight 115 while drop line weight 115 is secured in slot 112. Drop line weight 115 may be removed by first rotating and then sliding it towards the larger portion of slot 112. Display Pole 5 then is inserted through opening 29 of socket component 27 to cause ball 20 to engage socket component 27 while floatation reel 10 floats on the surface of the water.

Retrieval

As shown in FIGS. 12A-12G, retrieval of Buoy System 1 entails grasping floatation reel 10 and removing display pole 5 by sliding it through slot 29 in socket component 27. Floatation reel 10 then is positioned on winder 120 with slot 29 at the 6 O'clock position. Drop line weight 115 then is secured in slot 112 and anchor line 95 is pulled downward to release it from clip 115E. Anchor line 95 then is unwound from line lock 100 and floatation reel 10 then is rotated on winder 120. When anchor weight 98 engages line guide 123 on winder 120, floatation reel 10 is held stationary while display pole 5 is inserted into retaining notches 135A of winder 120 for storage.

The invention claimed is:

1. A buoy system comprising a buoyant flotation reel 10 in the form of a cylinder having an inner diameter and an outer diameter and a top surface wherein the buoyant flotation reel 10 includes a groove 12 in the periphery thereof for retaining a length of anchor line 95, the anchor line 95 having an anchor weight 98 attached thereto, a reel insert 15 positioned within the interior of the buoyant flotation reel 10 and connected to the buoyant flotation reel 10, a display pole 5 having a pivot ball 20 thereon mounted within a socket component 27 mounted on the reel insert 15, the socket component 27 configured to enable the pivot ball 20 on the display pole 5 to move within the socket component 27 to enable the display pole 5 to move relative to the reel insert 15, and wherein the display pole 5 has attached thereon a ballast weight 35 and further comprising winder 120 for attachment to reel insert 15 to enable retrieval of anchor line 95 onto buoyant flotation reel 10, winder 120 having a top 122, a base 124, and a midsection 126, midsection 126 having a center pin 127 to engage hole 110 of reel insert 15 wherein midsection 126 includes line guides 123 for guiding anchor line 95 onto floatation reel 10 during retrieval of anchor line 95.

2. A buoy system comprising, a buoyant flotation reel 10 in the form of a cylinder having an inner diameter and an outer diameter wherein the buoyant flotation reel 10 includes a groove 12 in the periphery of the buoyant flotation reel 10 for retaining a length of anchor line 95, the anchor line 95 having an anchor weight 98 attached thereto, a reel insert 15 positioned within the interior of the buoyant flotation reel 10 and connected to the buoyant flotation reel 10, a display pole 5 having a pivot ball 20 thereon mounted within a socket component 27 mounted on the reel insert 15, the socket component 27 configured to enable the pivot ball 20 on the display pole 5 to move within the socket component 27 to enable the display pole 5 to move relative to the reel insert 15, wherein the display pole 5 has attached thereto a ballast weight 35, and wherein an anchor line drop line weight 115 is attached to anchor line 95 distal to anchor weight 98.

3. The buoy system of claim 2 wherein reel insert 15 includes slot 112 for retaining drop line weight 115.

4. The buoy system of claim 2 wherein a message sign 60 is operatively connected to display pole 5.

5. The buoy system of claim 3 wherein reel insert 15 includes hole 110 for receiving a winder 120 for turning of buoyant flotation reel 10.

6. The buoy system of claim 5 further including an additional ballast weight 35A connected to buoyant flotation reel 10.

7. The buoy system of claim 6 wherein socket component 27 includes a hole 360 aligned with hole 110 on reel insert 15 for receiving pin 127 on winder 120.

8. The buoy system of claim 7 further comprising at least one of a camera 450, a light source 75 and a flotation ball 40 connected to the top of display pole 5.

9. The buoy system of claim 8 wherein message sign 60 is connected to display pole 5 by V-shaped holders 470.

10. The buoy system of claim 1 wherein arms 130A, 130B each include a plurality of adjacent recesses 195 configured to engage adjacent leg portions 193 on top 122.

11. The buoy system of claim 9 wherein reel insert 15 includes vertical raised rails 405.

12. The buoy system of claim 9 wherein reel insert 15 includes elongated end members 15A and 15B, each of the end members 15A,15B having teeth 15C for engaging grooves 10A in buoyant flotation reel 10 and wherein one or more of end members 15A includes anchor line tie 15BB for securing anchor line 95.

13. The buoy system of claim 1 wherein center pin 127 is configured in the form of nipple 465 and wherein socket component 27 includes hole 360A having slots 360B which may extend for a portion of or for the entire depth of hole 360A.

14. The buoy system of claim 1 wherein reel insert 15 includes spring loaded reel clamp 180 to retain buoyant floatation reel 10 on reel insert 15.

15. A kit for a buoy system comprising, a buoyant flotation reel 10 in the form of a cylinder having an inner diameter and an outer diameter wherein the buoyant flotation reel 10 includes a groove 12 in the periphery of the buoyant flotation reel 10 for receiving and retaining a length of anchor line 95, a length of anchor line 95, an anchor weight 98 for attachment to anchor line 95, a reel insert 15 for placement within the interior of the buoyant flotation reel 10 and for connection to the buoyant flotation reel 10, a display pole 5 having a pivot ball 20 thereon for mounting within a socket component 27 mounted on the reel insert 15 to enable the display pole 5 to move relative to the reel insert 15, and a ballast weight 35 for attachment to the display pole 5, and an anchor line drop line weight 115 for attachment to the anchor line 95 distal to the anchor weight 98.

16. The kit of claim 15 wherein the reel insert 15 includes slot 112 for retaining the drop Line weight 115.

17. The kit of claim 16 further comprising a message sign 60 for mounting on display pole 5.

18. The kit of claim 17 further comprising a winder 120 for connection to buoyant flotation reel 10.

19. The kit of claim 18 further comprising an additional ballast weight 35A for connection to buoyant flotation reel 10.

20. The kit of claim 19 further comprising at least one of a camera 450, a light source 75 and a flotation ball 40 for connection to the display pole 5.

21. The kit of claim 20 further comprising a V-shaped holder 470 for connecting message sign 60 to display pole 5.

22. The kit of claim 21 further comprising winder 120 for attachment to reel insert 15 to enable retrieval of anchor line 95 onto buoyant flotation reel 10, the winder 120 having a top 122, a base 124, and a midsection 126, the base 124 having handle 128 and arms 130A, 130B, the midsection 126 having a center pin 127 for engaging hole 110 of reel insert 15, and wherein the midsection 126 includes line guides 123 for guiding anchor line 95 onto floatation reel 10 during retrieval of anchor line 95.

23. The kit of claim 22 wherein the reel insert 15 includes vertical raised rails 405.

24. The kit of claim 15 wherein the reel insert 15 includes elongated end members 15A and 15B, each of the end members 15A, 15B having teeth 15C for engaging grooves 10A in buoyant flotation reel 10 and wherein one or more of end members 15A includes anchor line tie 15BB for securing anchor line 95.

25. The kit of claim 22 wherein reel insert 15 includes socket component 27 and midsection 126 includes center pin 127 configured in the form of nipple 465 for engaging socket component 27 on reel insert 15.

26. The buoy system of claim 4 wherein the message sign 60 is operatively connected to display pole 5 by retaining clamps 55A,55B.

27. The kit of claim 17 further comprising clamps 55A, 55B for retaining message sign 60 on display pole 5.

* * * * *